United States Patent [19]

Colombo

[11] Patent Number: 5,070,646

[45] Date of Patent: Dec. 10, 1991

[54] ANTI-THEFT DEVICE WITH EXTRACTABLE ARMORED COLUMN

[76] Inventor: Giorgio Colombo, Via Puccini 5, 21050 Cairate (Prov. of Varese), Italy

[21] Appl. No.: 583,114

[22] Filed: Sep. 17, 1990

[30] Foreign Application Priority Data

Sep. 26, 1989 [IT] Italy ..... 21838 A/89

[51] Int. Cl.[5] ..... E01F 13/00

[52] U.S. Cl. ..... 49/49; 404/6

[58] Field of Search ..... 49/49, 35, 131; 404/6, 404/9, 11; 256/13.1, DIG. 5

[56] References Cited

U.S. PATENT DOCUMENTS

| | | | |
|---|---|---|---|
| 693,061 | 2/1902 | Pegg | 256/DIG. 5 |
| 3,606,258 | 9/1971 | Fitch | 404/6 X |
| 3,660,935 | 5/1972 | Boots | 49/49 X |
| 3,698,135 | 10/1972 | Boots et al. | 49/49 X |
| 4,003,161 | 1/1977 | Collins | 49/131 X |
| 4,290,585 | 9/1981 | Glaesever | 404/6 X |
| 4,576,508 | 3/1986 | Dickinson | 49/131 X |
| 4,711,608 | 12/1987 | Ghusn | 49/49 X |
| 4,715,742 | 12/1987 | Dickinson | 49/49 X |
| 4,879,554 | 11/1989 | Diaz-Silveira | 49/49 X |
| 4,919,563 | 4/1990 | Stace | 404/6 |

FOREIGN PATENT DOCUMENTS

| | | | |
|---|---|---|---|
| 0227447 | 7/1987 | European Pat. Off. | 49/49 |
| 3322905 | 1/1985 | Fed. Rep. of Germany | 49/49 |
| 3534884 | 4/1986 | Fed. Rep. of Germany | 49/49 |
| 2495658 | 6/1982 | France | 49/49 |
| 2211233 | 6/1989 | United Kingdom | 49/49 |

*Primary Examiner*—Rodney M. Lindsey
*Assistant Examiner*—Jerry Redman
*Attorney, Agent, or Firm*—Guido Modiano; Albert Josif

[57] ABSTRACT

Anti-theft device with extractable armored column for protecting areas in general and for barring doors and the like, having a steel base which has the shape of an at least partially box-like body and which has walls which are at least partially covered with plates of a drill-proof metallic alloy or the like; the base is horizontally buriably in the walking surface and is centrally provided with a through opening; a vertical prism-shaped container made of steel is rigidly applied to the opening, has both longitudinal and transverse reinforcement ridges and is completely embedded below the walking surface; an armored column is telescopically and removably inserted in the container, is at least partially internally filled with material which has high resistance to abrasion and high hardness and has means for its anchoring to locking means present within the base.

5 Claims, 1 Drawing Sheet

ANTI-THEFT DEVICE WITH EXTRACTABLE ARMORED COLUMN

BACKGROUND OF THE INVENTION

The present invention relates to an anti-theft device with an extractable armored column which is particularly used for the perimetric protection of large areas and/or rooms used for the storage, exhibition, parking and the like of machines, devices and objects of large size and high intrinsic cost, such as for examples, automobiles. Various types of mechanical and electronic anti-theft devices with alarms are now widespread and are normally installed on access doors, windows and similar openings of storage rooms. The anti-theft devices are chosen in relation to the type of room which contains the products to be protected against theft, and obviously, because of the high value of the protected products, the anti-theft devices installed are chosen among the most sophisticated ones, which are then combined with armored doors of various types and with various mechanical resistances.

It is also known that any anti-theft device or armored door in practice cannot resist an attack on the part of highly specialized criminals equipped with modern effraction equipment; any type of armored door or safe can in fact be opened and the time required for this effraction obviously varies within wide limits according to the degree of resistance of the materials employed and to the type and dimensions of the door, safe or the like to be opened.

In the particular case of large areas, whether enclosed or open or covered, used for storing or parking expensive motor vehicles and the like, the problem of protection against theft is even more felt and difficult to solve with currently available anti-theft devices and armored doors.

SUMMARY OF THE INVENTION

The aim of the present invention is therefore to provide an anti-theft device which is conceived and structured so that its effraction or destruction is difficult and at least such as to require effraction times which are very long and therefore such as to allow a delay which is generally sufficient to allow the intervention of the means and personnel in charge of the repression of these crimes or also to discourage criminals to the point of forcing them to desist from the action which has been begun.

Another object of the invention is to provide a type of anti-theft device with or without alarm which is structured so that it can be installed at entrances or openings of enclosed or non-enclosed areas and at existing armored doors and which most of all is capable of effectively protecting large free areas used for the storage of heavy and bulky devices such as vintage or recent cars and similar products.

A further object of the invention is to provide an anti-theft device which is easy to install, simple to insert and extract and extremely resistant to attack with any currently available effraction means.

Besides the advantage of having high mechanical resistance, the anti-theft device according to the invention also offers the advantage of constituting, by means of the combination of a plurality of identical devices, an enclosure which is unassailable, or assailable with great difficulty and long effraction times, on open land or areas without requiring, for said land or areas, a particular arrangement or preparation for the installation of said anti-theft devices.

This aim, these objects and others which will become apparent from the following description are achieved by an anti-theft device for protecting open or enclosed areas, doors of rooms and the like, which is constituted, according to the present invention, by a steel base which has the shape of an at least partially box-like body and has walls at least partially covered by plates of drill-proof metallic alloy or the like, said base being horizontally buried in the walking surface and being centrally provided with a through opening, a vertical prism-shaped container made of steel being rigidly applied to said opening, said container having longitudinal and transverse reinforcement ridges and being completely embedded below the walking surface, an armored column being telescopically and removably inserted in said container, said column being at least partially internally filled with material with high abrasion resistance and high hardness and being provided with means for its anchoring to locking means provided inside and base, said column which protrudes from said base constituting a valid obstacle to the transit of vehicles and the like stored in the area protected by one or more extractable-column anti-theft devices.

More particularly, said telescopic container, said armored column and said central opening of the base have a quadrangular transverse cross section, whereas said column locking means are constituted by locks which actuate horizontal bolts which are internal to said base and can be inserted within openings or millings defined in the metallic body of the extractable column.

Said extractable column furthermore has, at its lower end, at least one pair of rollers or free wheels for facilitating transportation after extracting the buried container and has, at its upper end, at least one grip and maneuvering handle.

BRIEF DESCRIPTION OF THE DRAWINGS

The invention is now described in greater detail, according to a preferred and non-exclusive embodiment thereof, with reference to the accompanying drawings, which are given only by way of non-limitative example and wherein.

DESCRIPTION OF THE PREFERRED EMBODIMENTS

With reference to the above figures, the anti-theft device is substantially constituted by three hollow bodies and specifically by a base 1, by a container 2 which is rigidly anchored to the lower face of said base and by an armored column 3 which is telescopically insertable in, and extractable from, the container 2 through the base.

Figure 2:
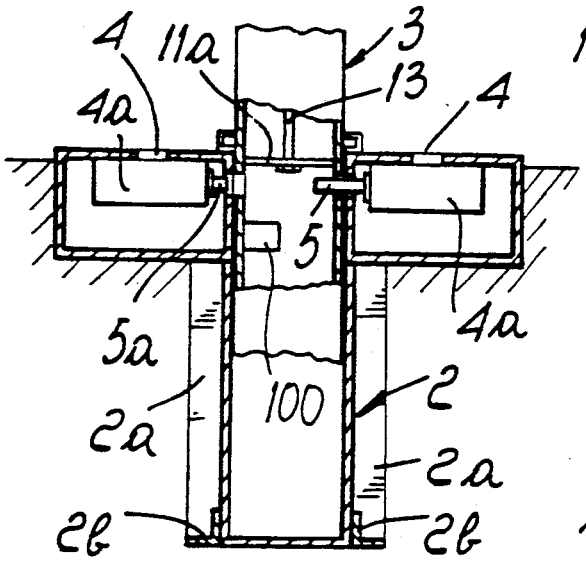
FIG. 2 is an elevation sectional view of the lower hollow part (telescopic container) of the device of FIG. 1.

The base 1 is constituted by a box-like body which has a quadrangular plan and is made of steel, inside which (FIG. 2) two opposite locks 4–4*a* with a dust protection cover are arranged and actuate two opposite bolts 5–5*a*. Said locks are of the type with safety keys having double bit with seven blades, and are protected both above and laterally by 10-mm steel box-like elements and by plates made of drill-proof and cut-proof alloy, preferably copper-manganese and steel-manganese alloys.

Figure 1:
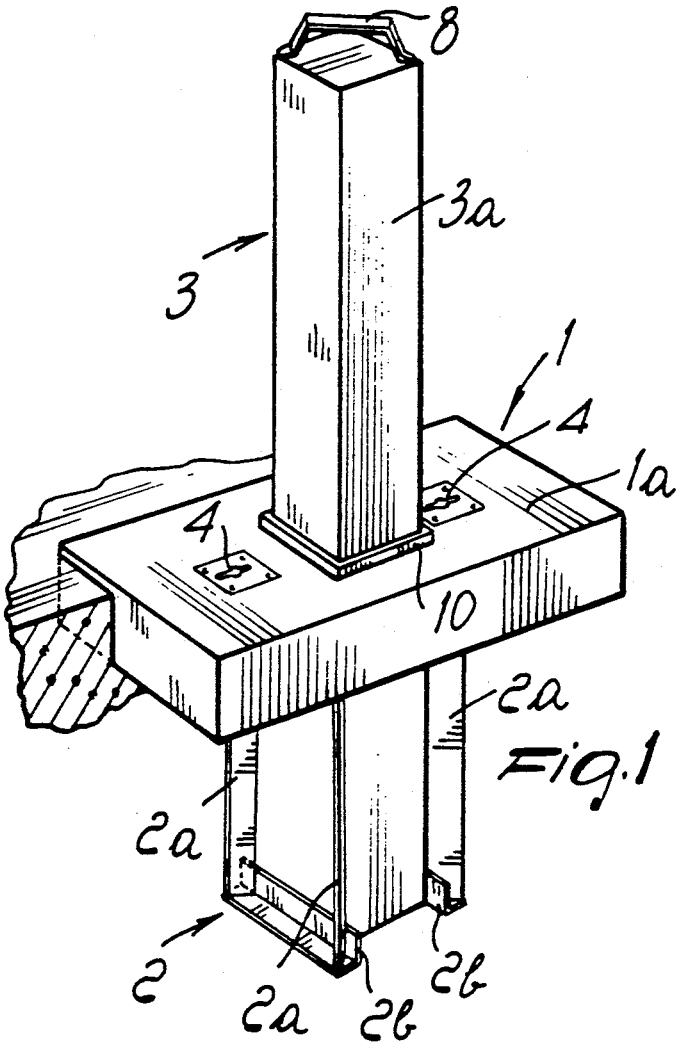
FIG. 1 is a perspective view of an extractable-column anti-theft device for open areas and the like, executed according to the invention and illustrated in installed condition.
Figure 3:
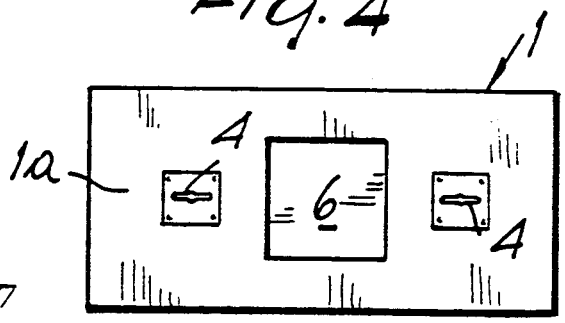
FIG. 3 is a top plan view of the alone of the device of FIG. 2, which can be placed flush to the roadbed.

The base is designed to be buried horizontally in the walking surface (soil, roadbed or floor) so as to leave the upper face exposed and so as not to constitute an obstacle for the passage of people and vehicles. A through opening 6 with a quadrangular shape (FIG. 3) is defined centrally with respect to the base and leads into the steel container (2) which is also quadrangular and has a transverse cross section which is identical to that of the opening 6 obtained from the base; reinforcements, constituted by wings or plates 2*a* made of steel and arranged along the outer edges of the container 2 and orientated along the diagonal lines of said container, as shown in FIG. 1, are welded or rigidly anchored to the container 2. L-shaped steel flaps 2*b* are furthermore applied to the base of the container 2. Said wings and said flaps, besides stiffening the container 2, allow a safer grip in the ground of said container and therefore greater safety against its extraction from the ground.

Figure 4:
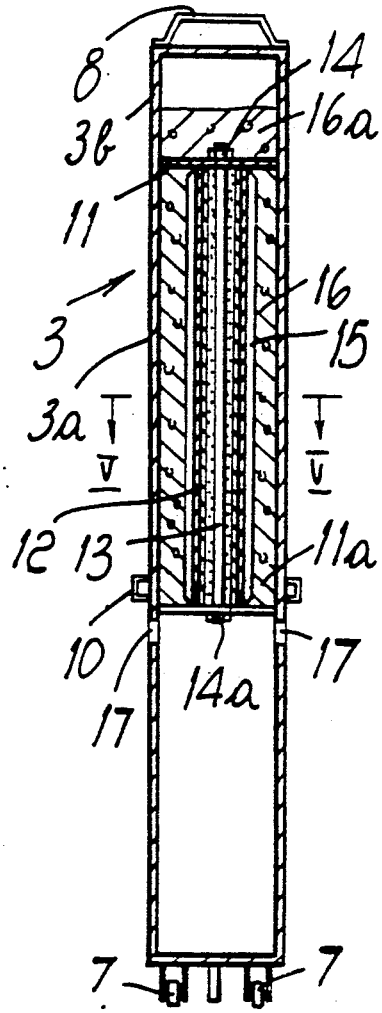
FIG. 4 is an elevation sectional view of the extractable armored column which can be telescopically coupled inside the container of FIG. 2.
Figure 5:
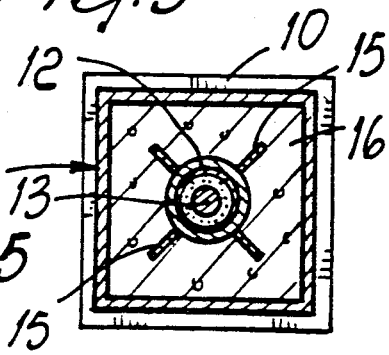
FIG. 5 is a transverse sectional view of the column of FIG. 4, taken along the line V—V of said FIG. 4.

The anti-theft device is furthermore provided with an extractable column 3 which has a quadrangular transverse cross section (FIGS. 4 and 5) and has such dimensions so as to be easily insertable in the container 2, passing through the opening 6 of the base, as illustrated in FIG. 1.

Said column is constituted by a quadrangular container made of steel which is internally hollow and is provided, at its lower end, with fixed or swivelling free wheels 7 with a parking brake for vertical positioning and, at its upper end, with one or more grip handles 8. A peripheral edge 10 is also provided on the column 3.

Said column 3 has such a length so as to have, after its positioning with the wheels 7 in contact with the bottom of the container 2 and with the peripheral edge 10, which internally contains a cutter-proof copper alloy, in contact with the upper wall 1*a* of the base, a protruding part 3*a* with a length sufficient to prevent the transit of vehicles or various machines, i.e. such as to constitute a substantial obstacle to the transit of vehicles and the like, for example, at least 40–45 cm from the base. The edge 10 of the column 3 also contains cement and a threaded steel rod.

At least the part 3*a* of the column which protrudes from the base is covered by, or entirely made of, metallic alloys with high resistance to perforation, cutting or the like, for example steel-manganese and copper-manganese alloys. A hollow tubular body 12 is furthermore interposed inside the part 3*a* between two opposite covers 11–11*a*, is positioned centrally to the column and is locked to said covers by means of a rod 13 and nuts or the like 14–14*a*. Longitudinal wings 15 are furthermore radially applied on the outer cylindrical surface of the tubular body 12 (FIGS. 4 and 5) and preferably are mutually equally angularly spaced and internally contain a cutter-proof copper alloy. An annular interspace 16 is thus created between the column 3 and the internal hollow body 12, and is completely filled with material with high resistance to perforation, cutting and abrasion; a composition particularly suitable for the purpose can be constituted, for example, by 50 parts by weight of cement, 25 parts of sand, 25 parts of gravel or quartz, 5 and up to 10 parts of corundum and 5 parts of fused cement.

This mixture can also be partially introduced in the portion 16*a* of the upper part 3*b* the column 3 which encloses the upper cover 11 to prevent access to the retainer 14 of the rod 13. The column finally has millings or openings 17 (FIG. 4) for the retention of the locking bolts 4–4*a* when the column is inserted in the container 2.

In practice, the above described device constitutes, due to the particular choice of the materials employed and to its compact structure, a valid obstacle to the transit of vehicles and the like which, though it might possibly be assailable and destructible with certain particular currently existing destructive methods, nonetheless certainly offers the advantage of requiring very long times for its elimination and the use of noisy, bulky and certainly very expensive and therefore not easily available effraction devices.

Finally, the above described device has such dimensions as to allow one person to perform the easy insertion, extraction and transportation of the armored column; transportation is furthermore facilitated by the existence of the end wheels.

The use of the extractable-column anti-theft device can in practice relate to any open or enclosed area or space or large room intended to store very bulky and expensive devices or means, such as for example luxury or vintage cars.

It is obvious that any type of acoustic or light-emitting alarm can be associated with said anti-theft device when it is installed in the opening of a door individually or together with other identical ones; the above described device can equally be provided, inside the container, with one or more electric contacts 100, which can be actuated by the illicit movement of the column or by impacts or blows on said column, suitable for activating alarms, sirens, telephones or the like.

It is also obvious that structurally equivalent modifications and variations can in practice be performed to the invention as described without abandoning the scope of the protection of said invention. The materials employed, the dimensions of the various constructive parts and the sites or areas to be protected can equally be varied according to the requirements.

I claim:

1. Anti-theft device for protecting open or enclosed areas and doors of rooms, comprising a steel base which has the shape of an at least partially box-like body and has walls at least partially covered by plates of drill-proof metallic alloy, said base being horizontally buryable in a walking surface and being centrally provided with a through opening, a vertical prism-shaped container made of steel being rigidly applied to said opening, said container having longitudinal and transverse reinforcement ridges and being completely embeddable below the walking surface, an armored column being telescopically and removably insertable in said container, said column being at least partially internally filled with material with high abrasion resistance and high hardness and being provided with means for its anchoring to locking means provided inside said base, said column which protrudes from said base constituting a valid obstacle to the transit of vehicles and the like stored in the area protected by one or more extractable-column anti-theft devices, wherein said column is constituted by a box-like body made of steel, said box-like body having an internal cavity, and defining a part protruding from said base, said internal cavity of at least said part of said box-like body which protrudes from the base being filled with material which is substantially unassailable by perforation means and cutting means, said material being retained by two opposite covers which are mutually rigidly associated by a central tubular spacer and by a related traction element arranged within said spacer.

2. Anti-theft device according to claim 1, wherein said extractable column has free resting wheels at its lower end, at least one grip handle at its upper free end and, in its median region, a raised peripheral edge suitable for constituting a stop means for said column against the base.

3. Anti-theft device according to claim 1, wherein said reinforcement means of the container are constituted by outer vertical wings and by L-shaped flaps which are transversely rigidly associated with the base of said container.

4. Anti-theft device according to claim 1, wherein said container and said armored column have a quadrangular, preferably square, transverse cross section.

5. Anti-theft device according to claim 1, further comprising, in a protected position, electric contact means suitable for actuating alarms in case of illicit extraction of, or tampering with, the extractable column.

* * * * *